US006508261B1

(12) United States Patent
Nezat, II

(10) Patent No.: US 6,508,261 B1
(45) Date of Patent: Jan. 21, 2003

(54) TUBULAR LINE KITING SYSTEM

(76) Inventor: Malvin A. Nezat, II, P.O. Box 1419, Splendora, TX (US) 77372

( * ) Notice: Subject to any disclaimer, the term of this patent is extended or adjusted under 35 U.S.C. 154(b) by 0 days.

(21) Appl. No.: 09/681,997

(22) Filed: Jul. 5, 2001

(51) Int. Cl.[7] ..... B08B 9/043
(52) U.S. Cl. ..... 134/167 C
(58) Field of Search ..... 15/104.061; 134/166 C, 134/167 C, 168 C, 169 C; 166/312; 4/255.06, 255.09

(56) References Cited

U.S. PATENT DOCUMENTS

| | | | | |
|---|---|---|---|---|
| 1,033,587 A | | 7/1912 | Hodgman | |
| 1,035,994 A | | 8/1912 | Mueller | |
| 2,481,152 A | | 9/1949 | Redmond | |
| 2,508,659 A | | 5/1950 | Brown | |
| 3,056,156 A | * | 10/1962 | Immel | 15/104.061 |
| 4,141,753 A | | 2/1979 | Creed | |
| 4,790,356 A | * | 12/1988 | Tash | 134/167 C X |
| 4,865,062 A | * | 9/1989 | Tash | 134/167 C |
| 4,957,123 A | * | 9/1990 | McHugh | 134/167 C |
| 5,336,333 A | | 8/1994 | Sheppard et al. | |
| 5,341,539 A | | 8/1994 | Sheppard et al. | |
| 5,364,473 A | | 11/1994 | Van Der Does | |

OTHER PUBLICATIONS

Website print–out for Tideflex check valves by Red Valve Co., Inc. (3 pp) (www.redvale.com/Brochure/tideflex.html).
Website print–out for Techno Corporation (2 pp) (www.technovalve.com).

* cited by examiner

*Primary Examiner*—Philip Coe
(74) *Attorney, Agent, or Firm*—Marsteller & Associates, P.C.

(57) ABSTRACT

A cleaning plug (P) adaptable to be placed within an interior passageway (10) of a tubular system (14) includes a generally conically shaped element (16) having a first end (18) and an opposite second end (20). The width (22) of the first end (18) fits within the tube (12). The width (24) of the second end (20) may be less than the first end (18). Rigging (26) is connected to the first end (18) to secure the conical element (16). A valve assembly (28) mounted with the second end (20) has a normally closed position (30) preventing appreciable fluid flow and an open position (32) permitting fluid flow (F) through the valve (28) if the flow pressure therethrough is greater than a minimum selected pressure.

14 Claims, 2 Drawing Sheets

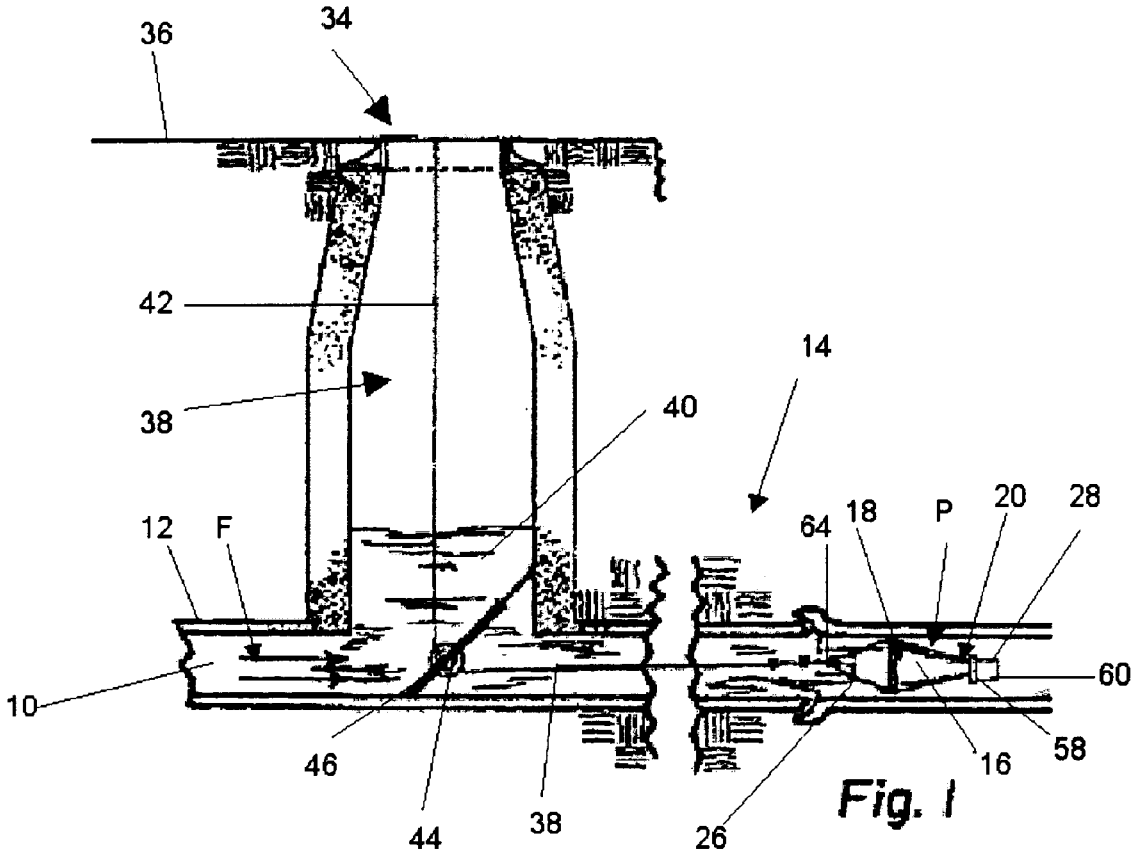
Fig. 1
Fig. 4A
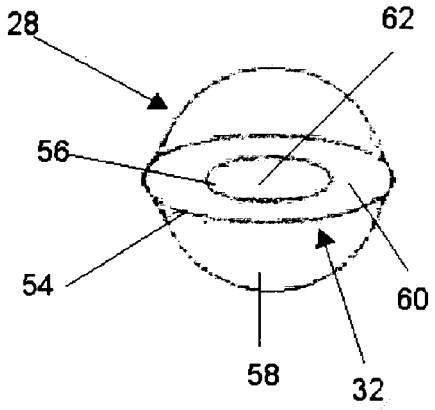
Fig. 4B
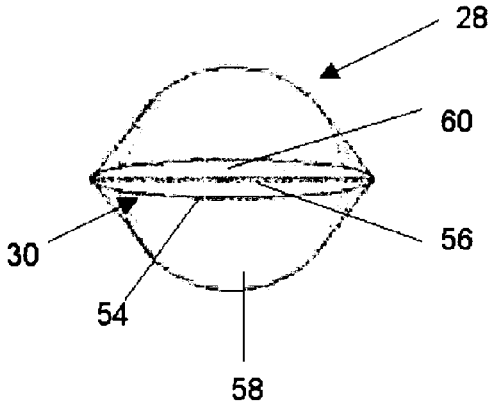

TUBULAR LINE KITING SYSTEM

BACKGROUND OF INVENTION

1. Technical Field

The invention relates to the field of ductwork or pipe interior cleaning systems and more particularly to an umbrella or parachute type cleaning plug apparatus for cleaning the interior of such ducts or pipes.

2. Background Art

Cleaning plugs or kites are used generally by cleaners of waste collection systems, air duct work, and the like for loosening solid materials, such as dirt, stone, mud and other debris, from the interior walls of pipes or ducts.

Kites and other types of cleaning plugs are well known in the pipe cleaning art. For example, U.S. Pat. Nos. 5,336,333; 5,341,539; 5,068,940; 1,035,994; 2,481,152; 2,508,659; 4,141,753; and, 5,364,473 teach various embodiments of cleaning plugs or kites for use in the cleaning of the interior of pipes.

A cleaning plug or kite may be placed in the interior either of a pipe, such as a sewer line, or a duct, such as an air handling or air conditioning system in a building. The fluid flowing in the pipe is blocked by the bag device thereby expanding the first end of the kite. Generally, the first end of the kite is sized such that when the kite is fully expanded the first end approximates the size or diameter of the interior of the pipe. The fluid flow is then either totally stopped or a pressurized stream may flow between the outer edge of the kite and the interior wall of the pipe. Alternatively, an opening may be formed in the apex of the kite or bag to permit fluid flow therethrough. Such flow through the formed opening would increase the pressure of the resulting stream exiting through the kite as a result of the fluid flowing through a reduced cross-sectional area. Finally, the pulling of the rigging securing the kite against the fluid pressure in the pipe often creates pockets or folds in the outer edge of the first end of the kite. Pressurized fluid jets or streams then can escape between the folds and the pipe's interior wall.

The relatively high pressure water or fluid is used to flush or wash undesired solid debris downstream through the pipe system.

Check valves are also well known in the art pertaining to valve structures. A check valves is a valve that permits flow in one direction only, that is to prevent backflow. Check valves have been used in past wastewater systems, such as in sluice gates. Known types of check valves include dual plate hinged and also all-rubber construction that seals and closes. An exemplary offeror of metal-hinged check valves is Techno Corporation of Millbury, Mass. (www.technovalve.com). Other check valve offerors are available and can be found readily through searching for check valves on the Internet.

However, such a known check valve has not been used in the field of cleaning plugs or kites.

While the above-cited references introduce and disclose a number of noteworthy advances and technological improvements within the art, none completely fulfills the specific objectives achieved by this invention.

SUMMARY OF INVENTION

In accordance with the present invention, a cleaning plug is adaptable to be placed within an interior passageway of a tube or duct within a tubular system, such as a sewer or air conditioning duct. The plug includes a bag or generally conically shaped element that has a first end and an opposite second end. The first end has a width selected to fit within the interior passageway of the tube. The second end has a width less than the width of the first end. A securing system or rigging is connected to the conical element in proximity to the first end for controllably securing the bag or conical element in desired positions within the interior passageway of the tube or duct.

A valve assembly is mounted with the second end of the conical element. The valve assembly has a normally closed position and an open state. The normally closed state prevents appreciable fluid flow therethrough. The open position permits fluid flow through the valve assembly upon sensing of a flow pressure therethrough greater than a minimum selected pressure value.

The valve assembly acts as a safety valve to prevent "blow-out" of the bag and also functions to provide a cleaning jet of fluid to flush undesired debris downstream of the kite.

These and other objects, advantages and features of this invention will b e apparent from the following description taken with reference to the accompanying drawings, wherein is shown the preferred embodiments of the invention.

BRIEF DESCRIPTION OF DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

FIG. 1 is a schematic diagram of an embodiment of the present kite invention within a tubular system, such as a sewer line.

FIG. 4*a* is a front view of one embodiment of the valve assembly in an open position permitting fluid flow.

FIG. 4*b* is a front view of the valve assembly of FIG. 4*a* in the normally closed position.

DETAILED DESCRIPTION

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

Figure 2A:
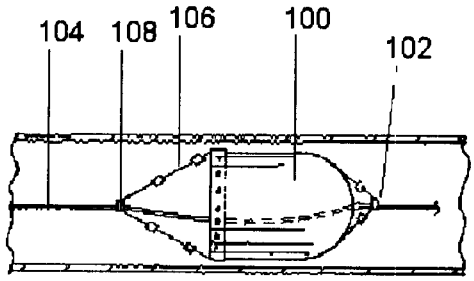
Fig. 2A PRIOR ART
FIG. 2*a* is an elevational view of one embodiment of a prior art kite.
Figure 2B:
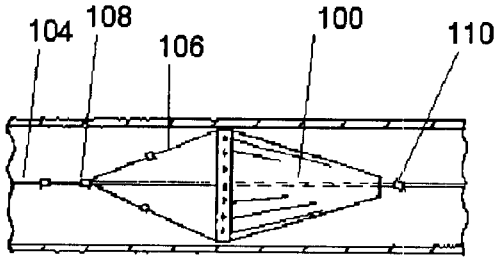
Fig. 2B PRIOR ART
FIG. 2*b* is an elevational view of another embodiment of a prior art kite.

FIGS. 2A and 2B teach two prior art embodiments of kites or cleaning plugs. FIG. 2A shows a bag or kite (100) having a manually releasable end (102) to collapse the kite that is effective to prevent damage from and over pressurization of the pipe being cleaned or to make the extraction of the cleaning kite from the pipe or duct work easier. A cable (104)

attached to rigging (106) at connection point (108) is secured to the kite (100).

FIG. 2B shows a kite (100) with a manually releasable plug (110) attached to a rope extending through the interior of the kite. Normally, the plug (110) is pulled to seal the open end of the kite or sleeve (100), but the introduction of slack in the plug line would permit the plug (110) to back away from the open end of the kite (100) and thereby opening the end of the kite (100) permitting fluid flow therethrough.

Referring now to FIGS. 1, 3, 4A, and 4B, the cleaning plug (P) of the present invention is adaptable to be placed within an interior passageway (10) of a tube or duct (12) within a tubular system (14). The plug (P) includes a bag or generally conically shaped element (16) that has a first end (18) and an opposite second end (20). The first end (18) has a width or diameter (22) selected to fit within the interior passageway (10) of the tube (12). The second end (20) may have a width or diameter (24) that is less than the width (22) of the first end (18).

A securing system or rigging (26) is connected to the conical element (16) in proximity to the first end (18) for controllably securing the conical element (16) in desired positions within the interior passageway (10) of the tube or duct (12).

A valve assembly (28) is mounted with the second end (20) of the conical element (16). The valve assembly (28) has a normally closed position (30) preventing appreciable fluid flow therethrough and an open position (32) permitting fluid flow (F) through the valve assembly (28) upon sensing of a flow pressure therethrough greater than a minimum selected pressure value.

FIG. 1 is a schematic diagram of one embodiment of the present kite being used in a typical sewer system (14) having a fluid flow F of a liquid (40), such as water, with solid or particulate matter, but the sewer system shown could be any type of piping system or air duct work, such as an air conditioning system of a building. With an air conditioning system, solid matter, such as dirt or dust, would line the interior walls of the air ducts and would be swept away with streams of pressurized air or other gas.

In FIG. 1 the tubular system (14) includes an access point or manhole (34) formed in the ground or surface (36). An interior connection member or channel (38) joins the manhole (34) and the interior channel (10) of the sewer line (12). The fluid or slurry of liquid and solid (40) fills at least a portion of the interior of the sewer system (12).

A rope or cable (42) traveling through the interior of the sewer system (14) extends between the surface (36) and a connection point (64) with the rigging (26) affixed to the conical element (16). The cable (42) restrains the kite (P) against being swept away in the flowing fluid (F) and controls the placement of the kite (P) within the pipe system (14). The cable (42) may optionally be supported around any corners by a pulley or wheel (44) attached to a brace (46) secured in the interior (10).

Figure 3:
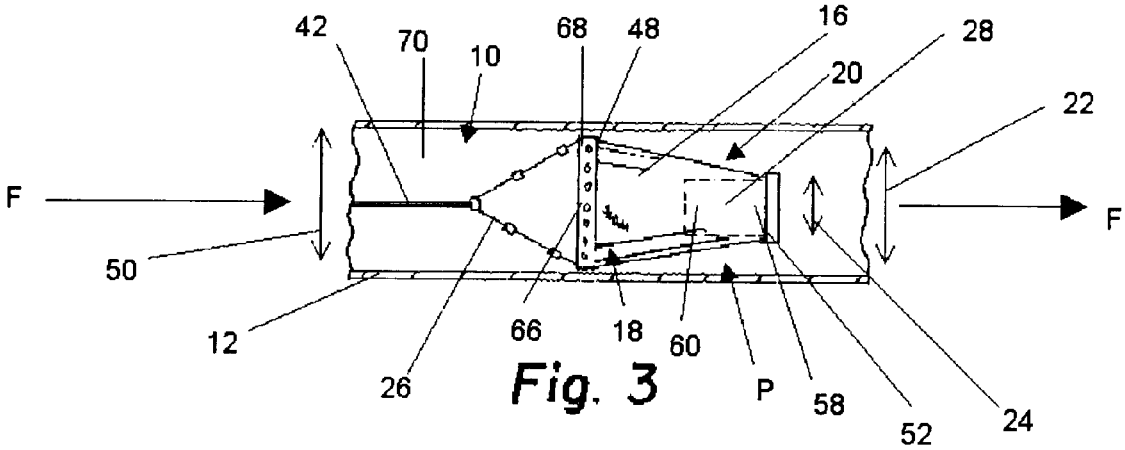
FIG. 3 is an elevational view of the present invention with an alternative mounting of the valve assembly.

In an alternative embodiment shown in FIG. 3, the cable (42) joins the rigging (26) at the connection point (64). An optional expansion ring (48) having a diameter or width (22) selected to be compatible with the interior diameter or width (50) of the pipe (12) may be formed with the open first end (18) to maintain the first end (18) in an open or expanded state or arrangement permitting fluid flow into the first end (18) of the conical element (16). The optional expansion ring or rigid hoop (48) works to keep the first end (18) of the conical element (16) open and may include brush portions or other abrasive segments (66) mounted about the outer periphery of the ring (48) to help in dislodging the solids or mud from the interior (10) of the pipe (12).

The width (22) of the first end (18) of the sleeve or bag (16) is chosen such that a desired amount of fluid may flow between an outer edge (68) of the first end portion (18) and the interior wall (70) forming the interior passageway (10) through the tubular system (14).

The apex or second end (20) of the conical element (16) is shown with a flange or other mount (52) joining the conical element (16) with the valve assembly (28). Preferably, the second end (20) is truncated forming an opening through which the fluid or slurry (40) may pass or flow.

The valve assembly (28) typically is a check valve type that permits fluid flow substantially only in one direction. The check valve is attached to the end of the open-ended sleeve or bag (16) such that desired fluid flow is permitted in the direction of travel from the first end (18) toward the second end (20) of the kite (P).

Known check valves can be formed from metal or an all-rubber construction. A wafer type of check valve may also be used. However, the weight of the valve assembly (28) acts to pull down the second end (20), and thus choosing a check valve having a lower weight is normally desired so as to be less of a drag on the sleeve (16). The weight of the valve assembly (28) and kite (P) is of particular concern when the pipe system is an air duct network and lightweight materials are desired.

The operator of the kite (P) would normally select the characteristics of the valve assembly (28) to match the anticipated fluid pressure in the sewer, the amount of fluid to flow through the valve assembly (28), the cross-sectional area of the opening (62), and the desired opening value for the valve assembly (28).

With reference to FIGS. 1, 4A and 4B, a preferred type of all-rubber check valve is shown in the open position (28) (FIG. 4A) and the normally closed position (30) (FIG. 4B). Generally, the check valve comprises a pipe or tube segment having a channel therethrough, and an exterior surface (54) and an interior surface (56) with one end (58) adapted to the mounted to been adjacent structure. An opposite end (60) is adapted to be normally pinched closed resembling a duck's bill unless a fluid pressure greater than a preset lower limit is introduced into the interior of the check valve pipe segment. When the fluid pressure in the interior of the check valve exceeds the minimum pressure, then the discharge end (60) opens forming a passageway (62) therethrough permitting fluid flow. Although it is preferred that fluid flow be totally restricted in the closed position, typically a certain, comparatively small amount of the liquid can flow through the valve in the closed position.

An alternative embodiment of the duckbill type of check valve is shown in FIG. 3 in which the fluid pressure against the exterior surface (54) of the check valve acts to open the check valve.

The conical element or bag (16) may be shaped like an open-ended sleeve, a windsock, a bag, or any other suitable shape taught by the prior art. The width (24) of the second end (20) is preferably less than the width (22) of the first end (18), but is a matter of choice or design. The conical element (16) should be made of a flexible material and can be made of nylon, rubberized or vinylized treated canvas, or any other material that is essentially impervious to the fluid flow therethrough.

The operation of the present kite (P) is similar to that of the prior art kites. The kite (P) is introduced into the interior passageway (10) of the sewer system (14) upstream of the area to be cleaned. The position of the kite (P) is controlled by the cable (42) attached to the rigging (26).

Water or other fluid flowing in the pipe system is blocked by the bag (16) of the kite (P) creating a hydrostatic head pressure behind (upstream) of the kite (P). The stopped water escapes under pressure either through the opening (62) in the valve assembly (28), or between the outer edge (68) of the first end (18) and the interior wall (70). Pulling in the rigging (26) may cause folds in the first end (18) thereby creating pressurized jets of water. The high-pressure streams of water are used to controllably flush or clean undesired solid debris downstream from the placement of the kite (P).

The foregoing disclosure and description of the invention are illustrative and explanatory thereof, and various changes in the size, shape and materials, as well as in the details of the illustrated construction may be made without departing from the spirit of the invention.

What is claimed is:

1. A cleaning plug adaptable to be placed within an interior passageway of a tubular system, the plug comprising:

a generally conically shaped element having a first end and an opposite second end; said first end and said second end having a width selected to fit within the interior passageway of the tubular system;

securing means connected to the conical element in proximity to the first end for controllably securing the conical element in desired positions within the interior passageway; and, a valve assembly mounted with the second end of the conical element;

said valve assembly having a normally closed position preventing appreciable fluid flow therethrough and an open position permitting fluid flow through the valve assembly upon sensing of a flow pressure therethrough greater than a minimum selected pressure value.

2. The invention of claim 1 in which the conical element is formed of a flexible material.

3. The invention of claim 1 wherein the conical element is a treated canvas material.

4. The invention of claim 1 wherein the conical element is formed of a material essentially impervious to the fluid flow.

5. The invention of claim 1 further including a substantially rigid hoop formed with the first end to maintain the first end in an open position permitting fluid flow into the first end of the conical element.

6. The invention of claim 1 wherein the width of the first end is chosen such that a desired amount of fluid may flow between an outer edge of the first end portion of the conical element and a wall forming the interior passageway of the tubular system.

7. The invention of claim 1 wherein the second end has a truncated ending permitting fluid flow therethrough.

8. The invention of claim 1 wherein the valve assembly comprises a check valve.

9. The invention of claim 1 wherein the valve assembly is composed of rubber.

10. The invention of claim 1 wherein the cleaning plug consists of lightweight materials suitable for cleaning an interior of an air duct system.

11. The invention of claim 1 wherein the second end having a width less than the width of the first end.

12. An improved cleaning plug adaptable to be placed within an interior passageway of a tubular system of the type that includes a generally conically shaped element having a first end and an opposite second end, the first end and second end having a width selected to fit within the interior passageway of the tubular system, and securing means connected to the conical element in proximity to the first end for controllably securing the conical element in desired positions within the interior passageway, the improvement comprising:

a check valve assembly mounted with the second end of the conical element; said valve assembly having a normally closed position preventing appreciable fluid flow therethrough and an open position permitting fluid flow through the valve assembly upon sensing of a flow pressure therethrough greater than a minimum selected pressure value.

13. The invention of claim 12 wherein the second end has a truncated ending permitting fluid flow therethrough.

14. The invention of claim 12 wherein the valve assembly is composed of rubber.

* * * * *